United States Patent [19]

Fujimura et al.

[11] Patent Number: 4,939,844

[45] **Date of Patent: * Jul. 10, 1990**

[54] MASTER PATTERN FOR UPPER GARMENTS

[75] Inventors: Shoji Fujimura, Yamatokoriyama; Toru Kawai, Osaka, both of Japan

[73] Assignee: Shikibo Ltd., Osaka, Japan

[ * ] Notice: The portion of the term of this patent subsequent to Feb. 7, 2006 has been disclaimed.

[21] Appl. No.: 249,936

[22] Filed: Sep. 27, 1988

Related U.S. Application Data

[62] Division of Ser. No. 74,179, Jul. 16, 1987, Pat. No. 4,802,282.

[30] Foreign Application Priority Data

Jul. 18, 1986 [JP] Japan ..... 61-170490

[51] Int. Cl.[5] ..... A41B 1/08

[52] U.S. Cl. ..... 33/12; 2/115

[58] Field of Search ..... 33/12, 13, 14; 2/93, 2/115, 125, 243 B

[56] References Cited

U.S. PATENT DOCUMENTS

| | | | |
|---|---|---|---|
| 2,369,416 | 2/1945 | Solomon | 2/115 |
| 2,426,819 | 9/1947 | Clyne | 2/93 |
| 2,725,566 | 12/1955 | Vogler et al. | 2/125 |
| 3,034,216 | 5/1962 | Fossey | 33/15 |
| 3,066,418 | 12/1962 | Terry et al. | 33/12 |
| 3,078,699 | 2/1963 | Huntley | 2/115 |
| 4,144,647 | 3/1979 | Mosky et al. | 33/12 |
| 4,631,756 | 12/1986 | Scrivens | 2/125 |
| 4,802,282 | 2/1989 | Fujimura et al. | 33/12 |

FOREIGN PATENT DOCUMENTS

| | | | |
|---|---|---|---|
| 366919 | 8/1939 | Italy | 2/93 |
| 382089 | 11/1964 | Switzerland | 33/12 |
| 771714 | 4/1957 | United Kingdom | 2/93 |

*Primary Examiner*—Thomas B. Will

*Attorney, Agent, or Firm*—Armstrong, Nikaido, Marmelstein, Kubovcik & Murray

[57] ABSTRACT

A master pattern for upper garments comprising three parts, a front part, a rear part and a lateral part integrated with a sleeve bottom, wherein sewing lines for sewing the lateral part to the front and rear parts are substantially parallel and straight, and a sewing line for sewing the front and rear parts to the lateral part and a sleeve attaching line bulge toward the lateral part to describe an L-shape with the sleeve root of the sleeve attaching line forming the apex, the sleeve bottom of the sleeve attaching line being located at the bottom of the cross-section of the arm root of the human body.

2 Claims, 4 Drawing Sheets

FIG. 4
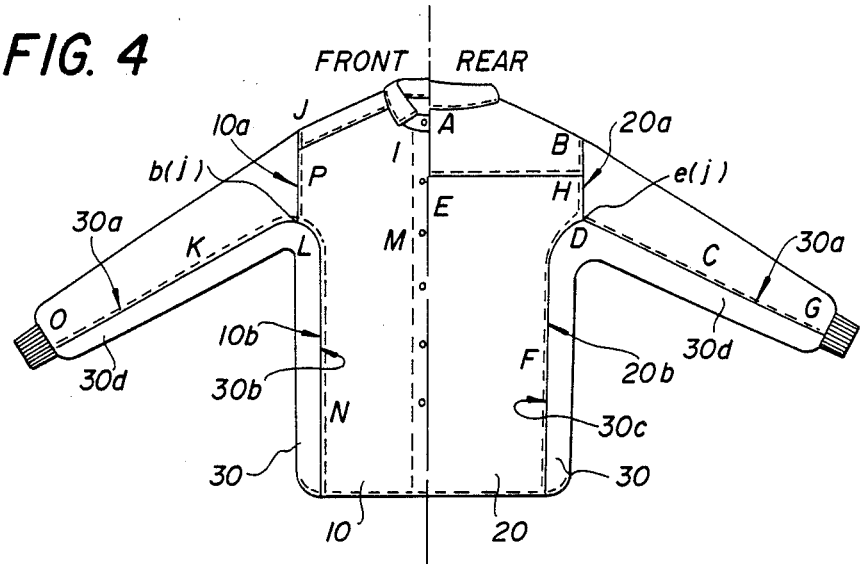
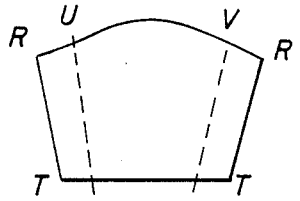
FIG. 12 PRIOR ART
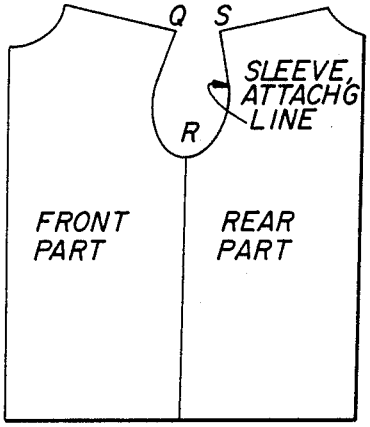
FIG. 5 PRIOR ART
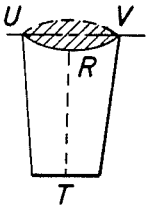
FIG. 13

MASTER PATTERN FOR UPPER GARMENTS

This is a now U.S. Pat. No. 4,802,282, Feb. 7, 1989 division, of application Ser. No. 074,179 filed July 16, 1987.

BACKGROUND OF THE INVENTION

1. Field of the Invention

This invention relates to a master pattern for upper garments, which is utilized for dressmaking.

2. Prior Art

A conventional master pattern for upper garments is made with a primary object of creating a beautiful silhouette in a stationary state and comprises a curve which extends along an ellipse which appears when a three-dimensional structure simulating the human body is cut at each joint (see FIG. 5).

Generally, as to functions required of upper garments, it is an important item to avoid inconveniences in daily life activities, it being of vital importance how to determine the amount of dimensional allowance in order to cope with changes in the size of the human body on the basis of said daily life activities.

With the technique of making silhouettes beautiful in a stationary state as in the case of a conventional master pattern for upper garments, however, the function associated with bodily movements is not sufficient, the upper garment being often worn out of shape even in daily life activities; particularly in the field of sportswear, there is no choice but to use a stretchable material in order to compensate for said point.

Such stretchable material, however, is made effective solely by friction between the skin of the human body and the fabric surface of the garment, a phenomenon which gives a sense of oppression on the human body, sometimes interfering with smooth movement; further, perspiration or the like changes the frictional force from time to time, further increasing a sense of oppression on the human body and impeding movability.

In shirts and upper garments, when the wearer moves his body, local tightening impeding movability takes place in response to muscle movements.

The relationships between places where said local tightening takes place are classified as follows.

Item 1

Concerning places on upper garments where local tightening takes place when the arms are moved with the back kept straightened:

A. When the arms are stretched upward (in the direction of Y axis), local tightening takes place in opposite sides of the waist with the upper arms serving as force application points (see FIG. 6).

B. When the arms are stretched horizontal along the sides of the body (in the direction of X axis), the result is the same as in the A above (see FIG. 7).

C. When the arms are stretched forward (in the direction of Z axis), local tightening takes place in regions extending from the rear arm roots and along the back width lines, with the upper arms serving as force application points (see FIG. 8).

Item 2

Concerning places on upper garments where local tightening takes place when the back is bent back and forth:

Local tightening takes place on the center line of the body with the root of the neck serving as a force application point (see FIG. 9).

Item 3

Concerning places on upper garments where local tightening takes place when the back is bent right and left:

Local tightening takes place on lateral lines on the body with the shoulders serving as force application points (see FIG. 10).

Item 4

Concerning places on upper garments where local tightening takes place when the upper half of the body is twisted with the shoulders fixed:

Local tightening takes place on lines extending to the waist with the shoulders serving as force application points (see FIG. 11).

Bodily motions which people make in their daily life and sports activities consist one or combinations of the items described above. In the case of single movements described in Items 2 through 4, they can be compensated for by conventional dimensional allowances or simply by the selective use of such sleeves as raglan sleeves and dolman sleeves. However, the problem of local tightening taking place in upper garments owing to combined movements including Item 1 or by the single movement of Item 1 cannot be solved by conventional master patterns for upper garments.

An analysis of the phenomena that cannot be compensated for by said conventional dimensional allowances has revealed that they lie in the following two main factors.

(1) The amounts of movement in regions (armpits) below the arm roots in the X, Y and Z directions.

(2) The amounts of movement on sewing lines in regions extending forwardly and rearwardly of the arm roots to the lateral parts and the front part and to the lateral parts and the rear part of the body of the garment.

It has been impossible to cope with the amounts of movement in said two points by conventional master patterns for upper garments.

In addition, in FIG. 5, a curve extending from Q via R to S forms a sleeve attaching line, the R forming an armhole bottom, and a sleeve to be attached thereto is shown in FIG. 12 and it will be sewn so that R marks coincide with each other.

When the sleeve is divided along dotted lines U and V and sewn along sleeve bottom sewing lines UV, a sleeve bottom shown in FIG. 13 is obtained. The U and V points in FIG. 13 correspond to points of inflection on the sleeve root curve.

In FIG. 13, when the arms are raised and lowered (FIG. 6), it is clear that the shaded missing portion forms a portion which impedes movements.

If design drawings for sleeves and sleeve attaching lines are changed with said points taken into consideration, they depart from the curve of the human body, not only destroying the silhouette but also resulting in bagginess so that the excessive portion of the upper garment impedes movements. Furthermore, such change is ineffective with respect to the aforesaid factor 2.

SUMMARY OF THE INVENTION

This invention provides a master pattern for upper garments comprising three parts, a front part, a rear part and a lateral part integrated with a sleeve bottom, wherein sewing lines for sewing the lateral part to the front and rear parts are substantially parallel and straight, and a sewing line for sewing the front and rear parts to the lateral part and a sleeve attaching line bulge toward the lateral part to describe an L-shape with the sleeve root of said sleeve attaching line forming the apex, the sleeve bottom of the sleeve attaching line being located at the bottom of the cross-section of the arm root of the human body.

In the master pattern for upper garments according to the invention, because of the facts that it comprises three parts, a front part, a rear part and a lateral part integrated with a sleeve bottom, that the L-shaped portions of the sewing lines for sewing the front and rear parts to the lateral part provide an allowance for forward and backward and oblique movements of the arm and bending and twisting movements of the human body, and that the sleeve bottom is integrated with the lateral part, it is possible to provide an allowance for upward and downward movements of the arm and bending and twisting movements of the human body. Further, because of the fact that the sleeve bottom of the sleeve attaching line is located at the bottom of the cross-section of the arm root of the human body, it is possible to concentrate all allowances at a place below the armpit in terms of nude body size; thus, it is possible to keep the silhouette beautiful and to avoid bagginess.

BRIEF DESCRIPTION OF THE DRAWINGS

FIG. 4 is a view for explaining a shirt made with the master pattern for upper garments according to the invention and for explaining check points necessary from the standpoint of sports functions;

FIG. 5 is a front view of a conventional master pattern for upper garments;

FIG. 12 is a developed view of a sleeve to be sewn to the conventional master pattern; and FIG. 13 is a front view of a sleeve bottom, in a stationary state, sewn to the conventional master pattern for upper garments.

DESCRIPTION OF THE PREFERRED EMBODIMENTS

Figure 1:
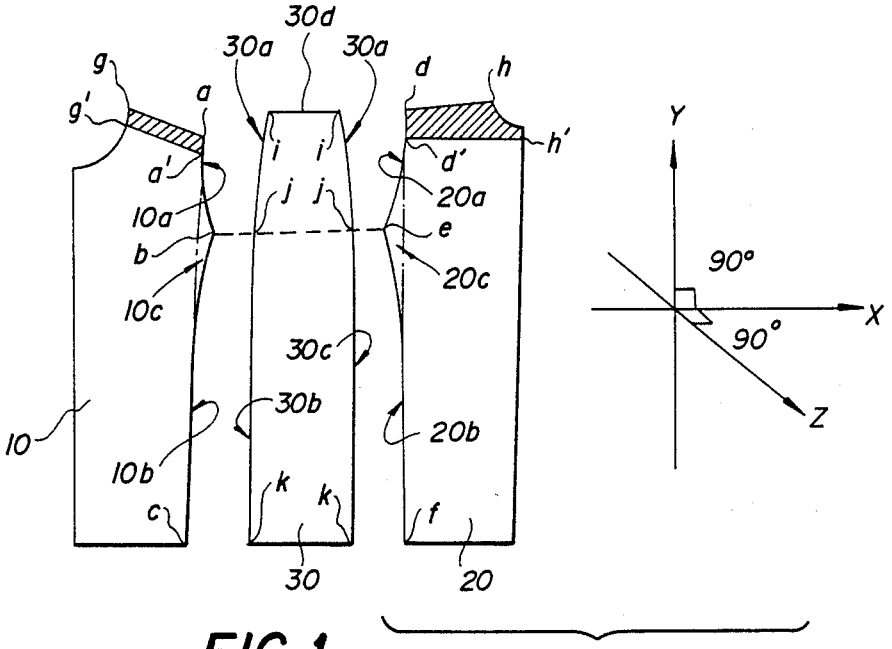
FIG. 1 is a front view of a master pattern according to the present invention.

FIG. 1 shows a master pattern for upper garments according to the invention. The numeral 10 denotes a front part; 20 denotes a rear part; and 30 denotes a lateral part.

A line from point a to point b forms a sleeve attaching line 10*a*, and a line from point b to point c forms a lateral part sewing line 10*b*. The sleeve attaching line 10*a* and lateral part sewing line 10*b* define a portion 10*c* which bulges toward the lateral part 30 to describe an L-shape with point b serving as the apex.

Said point b serves as the sleeve bottom of the sleeve attaching line 10*a* of the front part 10.

A line from point d to point e on the rear part 20 forms a sleeve attaching line 20*a*, and a line from point e to point f forms a rear part sewing line 20*b*. The sleeve attaching line 20*a* and the lateral part sewing line 20*b* defines a portion 20*c* which bulges toward the lateral part 30 to describe an L-shape with point e serving as the apex.

Said point e serves as the sleeve bottom of the sleeve attaching line 20*a* of the rear part 20.

Each line from point i to point j forms a sleeve attaching line 30*a*, and lines from points j to points k form a front part sewing line 30*b* and a rear part sewing line 30*c*. The front part sewing line 30*b* and the rear part sewing line 30*c* are symmetrical, substantially parallel lines, and points j are adapted to coincide with points b and e on the front and rear parts 10 and 20, the region above said points j providing a sleeve bottom 30*d*.

Figure 2:
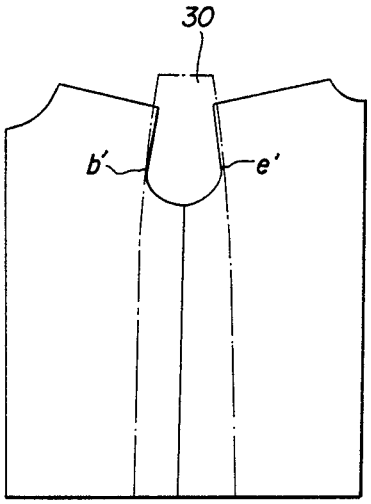
FIG. 2 is a view for explaining the amount of movement where the lateral part of the invention is placed on a conventional master pattern for upper garments.

In FIG. 1, points a and d correspond to points Q and R, respectively, in the conventional master pattern for upper garments shown in FIG. 5. Points b and e in FIG. 1 correspond to the armpit of a human nude body, i.e., the bottom position of the cross section of the arm root of the human body and also correspond to positions b' and e' in FIG. 2 in which the lateral part 30 of the invention is placed on the conventional master pattern for upper garments shown in FIG. 5; the fact that this portion is bulged in L-shape means that this is the most important point where the slack in a stationary state is accommodated in the armpit.

The lateral part 30 is sewn to the front part 10 along the line from point b to point c and to the rear part 20 along the line from point e to point f, thus providing the amount of movement in the Z direction (which is perpendicular to the paper surface of FIG. 1).

Figure 3:
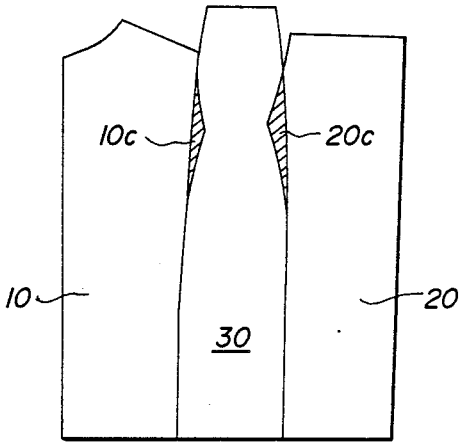
FIG. 3 is a view for explaining the amount of movement where the various parts of master pattern of the invention are put together.
Figure 6:
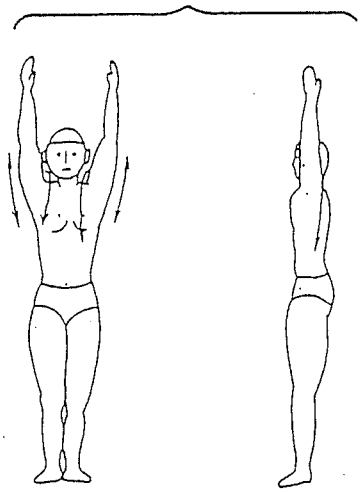
FIGS. 6 through 11 are views for explaining places on an upper garment where local tightening takes place owing to movements of the human body.
Figure 7:
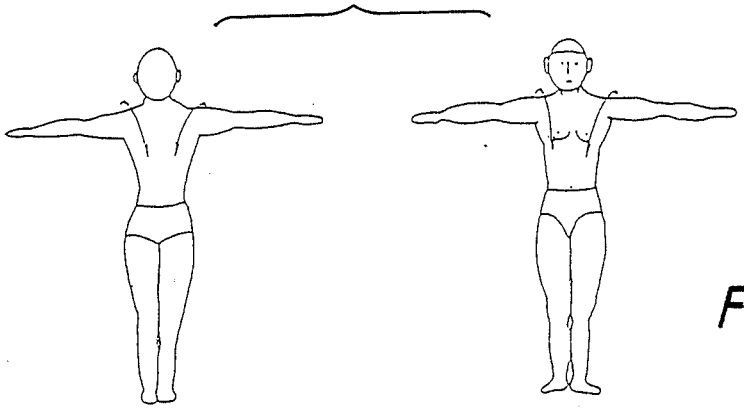
Figure 8:
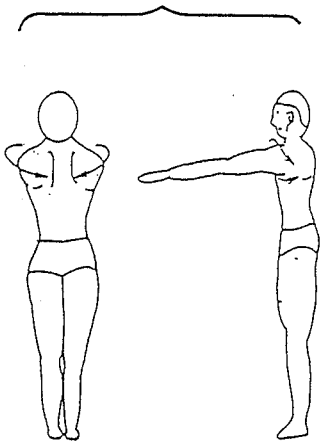
Figure 9:
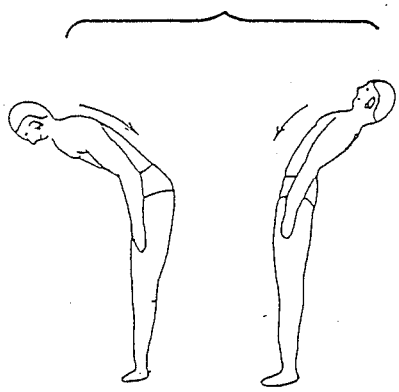
Figure 10:
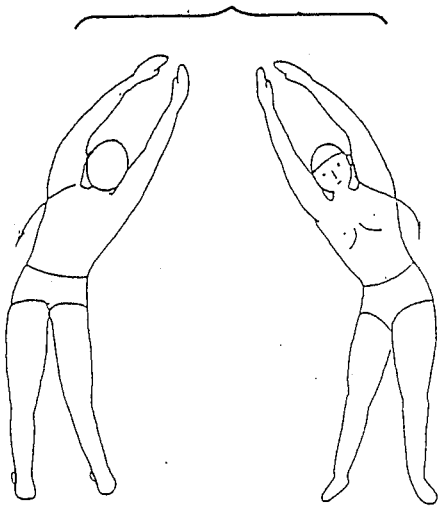
Figure 11:
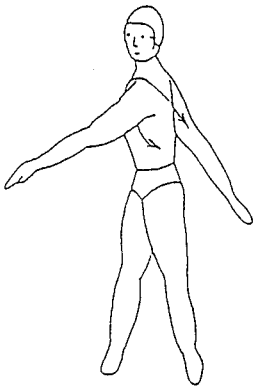

FIG. 3 shows the various parts of FIG. 1 put together flatwise along their sewing lines; the L-shaped bulging portions shown shaded provide the amounts of movement described in the aforesaid factor 2.

In addition, in FIG. 1, lines from point a to point g and from point d to point h, respectively, are yoke sewing lines, and yokes (shaded areas) will eliminate the heavy feeling which is brought about when one puts on the garment, but such yokes, which will vary with design and the like, have little to do with sports functions.

FIG. 4 shows an embodiment of an upper garment according to the invention, in the form of a long-sleeved shirt, the left half indicating the front part and the right half the rear part. Wearing tests conducted using this shirt have shown that none of 100 people felt a sense of oppression or local tightening taking place in check points I through P in the front part and check points A through H in the rear part.

According to this invention, there is obtained an upper garment which eliminates the possibility of local tightening taking place in the various parts owing to movements and of friction being produced between the fabric surface of the garment and the skin of the human body and which is prevented from being worn out of shape and which, moreover, ensures a beautiful silhouette in a stationary wearing state while eliminating bagginess.

What is claimed is:

1. An upper garment comprising:

front and rear parts each of which having a first sewing side line at one side thereof, each of said first sewing side lines having an upper end, a first substantially straight lower portion and an outwardly projected upper portion therebetween, each of said outwardly projected upper portions having a bulging portion intermediate said upper end and said first substantially straight lower portion meeting to define an apex for constituting a sleeve root; and a lateral part being sewn with said front and rear parts at each sides thereof, said lateral part having two second sewing side lines at each side thereof and including an upper portion for constituting a sleeve bottom and a lower portion for interconnecting said front and rear parts, each of said two second side lines having a substantially straight portion of said lower portion thereof, wherein each of said first substantially straight lower portions and a lower half of each of said bulging portions of said first sewing side lines being sewn with each of said second substantially straight portions of said two second sewing side lines, and each of said upper ends, each of said apex and an upper half of each of bulging portion being sewn with said sleeve root.

2. The upper garment according to claim 1 wherein said upper garment further comprises a sleeve part having said sleeve root.

* * * * *